US011203894B1

(12) United States Patent
Wang

(10) Patent No.: US 11,203,894 B1
(45) Date of Patent: Dec. 21, 2021

(54) DOOR PANEL

(71) Applicant: Nan Ya Plastics Corporation, Taipei (TW)

(72) Inventor: Kuei-Yung Wang, Taipei (TW)

(73) Assignee: NAN YA PLASTICS CORPORATION

( * ) Notice: Subject to any disclaimer, the term of this patent is extended or adjusted under 35 U.S.C. 154(b) by 0 days.

(21) Appl. No.: 17/227,429

(22) Filed: Apr. 12, 2021

(51) Int. Cl.
*E06B 3/70* (2006.01)
*E06B 3/82* (2006.01)

(52) U.S. Cl.
CPC ..... *E06B 3/7001* (2013.01); *E06B 3/7015* (2013.01); *E06B 3/825* (2013.01); *E06B 2003/7023* (2013.01); *E06B 2003/7049* (2013.01)

(58) Field of Classification Search
CPC ..... E06B 3/7001; E06B 3/7015; E06B 2003/7203; E06B 2003/7051; E06B 2003/7049; E06B 3/76; E06B 3/825; E06B 5/16
See application file for complete search history.

(56) References Cited

U.S. PATENT DOCUMENTS 5,155,959 A * 10/1992 Richards ..... B28B 5/027 52/455
5,644,870 A * 7/1997 Chen ..... E06B 3/7001 49/501
7,895,801 B2 * 3/2011 White ..... E06B 7/30 52/455
9,932,767 B2 * 4/2018 Matsuo ..... E06B 3/70
2002/0092254 A1 * 7/2002 Wang Chen ..... E06B 3/5892 52/455
2003/0005645 A1 * 1/2003 Wang Chen ..... E06B 5/16 49/501
2003/0033786 A1 * 2/2003 Yulkowski ..... E06B 5/16 52/784.15
2006/0248833 A1 * 11/2006 Autovino ..... E06B 5/16 52/455
2011/0131921 A1 6/2011 Chen
2014/0130432 A1 * 5/2014 Stewart ..... E04B 1/98 52/215
2014/0370215 A1 * 12/2014 Collison ..... B32B 7/12 428/36.2

OTHER PUBLICATIONS

UK Combined Search and Examination Report Under Sections 17 and 18(3), dated Jun. 29, 2021, issued in corresponding UK Patent Application No. GB2105199.0. Total 5 pages.

* cited by examiner

*Primary Examiner* — Beth A Stephan
(74) *Attorney, Agent, or Firm* — Ostrolenk Faber LLP

(57) ABSTRACT

A door panel comprising a body having front and rear door skins delimiting an interior for sandwiching filling material, an interlock provided with the body and configured to lock the front and rear skins and thereby prevent displacement of the front and rear skins along at least two transverse directions, and a reinforcement member provided between the front and rear door skins and extending transversely to the interlock for providing reinforcement to the body.

19 Claims, 8 Drawing Sheets

Date: 2021.01.12, Country: Taiwan, Time: 60 mins, Burn on the side, Room #31

Conventional door undergo fire test to check for deformation

Conventional Door Panel (1110mmX2388mm)
Conventional Door Frame (1200mm x 2500mm)
Skin – Glass fiber and knitted yarn bundle
Core – Phenolic Foam
Lock Side – Wooden structure with wooden stile
Hinge Side – Wooden structure with wooden stile
Upper Side – Wooden Rail
Lower Side – Wooden Rail
Upper and Lower intumescent stripe
Left and Right PVC welt

| Time (Min) | 0 | 2 | 4 | 6 | 8 | 10 | 12 | 14 | 16 | 18 | 20 | 22 | 24 |
|---|---|---|---|---|---|---|---|---|---|---|---|---|---|
| Time (Sec) | 0 | 120 | 240 | 360 | 480 | 600 | 720 | 840 | 960 | 1080 | 1200 | 1320 | 1440 |
| Temp °C | 16 | | 586 | 693 | 769 | 777 | 803 | 824 | 888 | 915 | 930 | 942 | 955 |
| A' | 96.7 | 96.0 | 97.6 | 103.0 | 106.0 | 106.4 | 107.8 | 110.5 | 114.6 | 117.8 | 119.2 | 120.2 | 121.5 |
| Deformation | 0 | -0.7 | +0.9 | +6.3 | +9.3 | +9.7 | +11.1 | +13.8 | +17.9 | +21.1 | +22.5 | +23.5 | +24.8 |
| B' | 93.2 | 91.4 | 96.0 | 97.0 | 98.2 | 98.8 | 99.6 | 101.7 | 103.1 | 104.3 | 105.1 | 105.6 | 106.0 |
| Deformation | 0 | -1.8 | +2.8 | +3.8 | +5.0 | +5.6 | +6.4 | +8.5 | +9.9 | +11.1 | +11.9 | +12.4 | +12.8 |
| C' | 98.2 | 98.4 | 99.4 | 101.0 | 102.4 | 102.2 | 103.0 | 103.9 | 104.8 | 105.0 | 105.1 | 105.1 | 105.1 |
| Deformation | 0 | +0.2 | +1.2 | +2.8 | +4.2 | +4.0 | +4.8 | +5.7 | +6.6 | +6.8 | +6.9 | +6.9 | +6.9 |

| Time (Min) | 26 | 28 | 30 | 32 | 34 | 36 | 38 | 40 | 42 | 44 | 46 | 48 | 50 |
|---|---|---|---|---|---|---|---|---|---|---|---|---|---|
| Time (Sec) | 1560 | 1680 | 1800 | 1920 | 2040 | 2160 | 2280 | 2400 | 2520 | 2640 | 2760 | 2880 | 3000 |
| Temp °C | 961 | 1048 | 1043 | 987 | 1047 | 1040 | 1081 | 1087 | 1064 | 1162 | 1210 | 1234 | 1247 |
| A' | 122.2 | 124.1 | 126.8 | 130.0 | 132.5 | 133.7 | 134.1 | 134.4 | 136.1 | 138.9 | 140.0 | 143.7 | 146.3 |
| Deformation | +25.5 | +27.4 | +30.1 | +33.3 | +35.8 | +37.0 | +37.4 | +37.7 | +39.4 | +42.2 | +43.3 | +47.0 | +49.6 |
| B' | 106.3 | 106.6 | 107.3 | 107.9 | 108.1 | 108.2 | 108.2 | 108.6 | 108.7 | 108.9 | 109.2 | 109.0 | 109.0 |
| Deformation | +13.1 | +13.4 | +14.1 | +14.7 | +14.9 | +15.0 | +15.0 | +15.4 | +15.5 | +15.7 | +16.0 | +15.8 | +15.8 |
| C' | 105.6 | 106.0 | 107.0 | 108.1 | 108.6 | 108.7 | 109.2 | 109.3 | 109.4 | 110.0 | 110.4 | 110.0 | 110.0 |
| Deformation | +7.4 | +7.8 | +8.8 | +9.9 | +10.4 | +10.5 | +11.0 | +11.1 | +11.2 | +11.8 | +12.2 | +12.8 | +12.8 |

At 49 min, fire comes out from A' position of the door

At 50 min, experiment ended

Test points

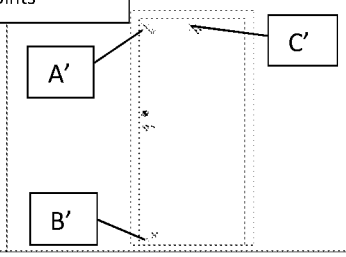

Figure 6

Date: 2021.01.12, Country: Taiwan, Time: 60 mins, Burn on the side, Room #32

Door according to the invention undergo fire test to check for deformation

Conventional Door Panel (1110mmX2440mm)
Conventional Door Frame (1200mm x 2500mm)
Skin – Glass fiber and knitted yarn bundle
Core – Phenolic Foam
Lock Side – Wooden structure embedded with reinforcement member and sealed with wooden stile
Hinge Side – Wooden structure embedded with reinforcement member and sealed with wooden stile
Upper Side – Wooden Rail
Lower Side – Wooden Rail
Upper and Lower intumescent stripe
Left and Right PVC welt

| Time | | Back temperature point | | | | | | Deformation/ change | | | | | |
|---|---|---|---|---|---|---|---|---|---|---|---|---|---|
| Min | Sec | Oven Temp °C | A | B | C | D | E | A' | Deformation/ Change | B' | Deformation/ Change | C' | Deformation/ Change |
| 0 | 0 | | 24 | | | | | 106.4 | 0 | 107.6 | 0 | 110.0 | 0 |
| 5 | 300 | 726 | 27 | 27 | 27 | 25 | 27 | 108.4 | +2.0 | 105.2 | -2.4 | 113.8 | +3.8 |
| 10 | 600 | 881 | 30 | 41 | 31 | 29 | 33 | 113.2 | +6.8 | 105.6 | -2.0 | 107.5 | -2.5 |
| 20 | 1200 | 777 | 56 | 63 | 39 | 41 | 58 | 117.8 | +11.4 | 107.0 | -0.6 | 83.7 | -26.3 |
| 30 | 1800 | 888 | 74 | 71 | 54 | 56 | 75 | 121.4 | +15.0 | 108.0 | +0.4 | 81.9 | -28.1 |
| 40 | 2400 | 935 | 87 | 80 | 69 | 70 | 87 | 123.8 | +17.4 | 107.9 | +0.3 | 81.8 | -28.2 |
| 50 | 3000 | 965 | 100 | 94 | 95 | 88 | 108 | 124.0 | +17.6 | 107.9 | +0.3 | 79.1 | -30.9 |
| 60 | 3600 | 994 | 111 | 154 | 109 | 98 | 119 | 124.6 | +18.2 | 106.2 | -1.4 | 65.4 | -44.6 |
| 70 | 4200 | 1022 | 131 | 186 | 176 | 130 | 145 | 124.3 | +17.9 | 104.7 | -2.9 | 61.7 | -48.3 |

Observation
at 65 sec Inner layer cracking sound
at 1070 sec intumescent stripe squeezed out and softened
at 2548 sec door skin protrude at position F at 162°C
at 2710 sec door skin protrudes at position G at 148°C (at 3450 sec, position G becomes dark brown)
at 2855 sec handle, hinge are burnt to dark color
at 2912 sec door skin protrudes at position H at 221°C (over temperature)
at 3066 sec door skin protrudes at position I at 237°C
at 3760 sec all carbonized points has a temperature of about 250°C
at 4020 sec position F is 302°C, position G is 292°C, position H is 281°C, position I is 287°C
at 4200 sec position F becomes white
at 4320 sec test ended Test points

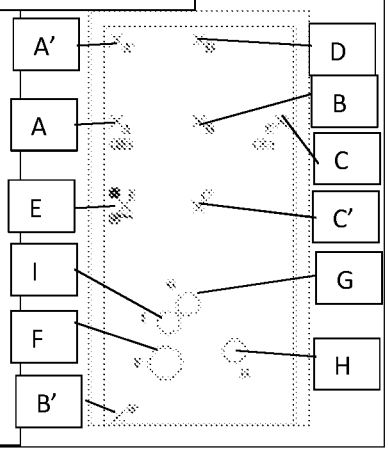

Figure 7

DOOR PANEL

The present invention relates to a door panel for example particularly, but not exclusively, a door panel with reinforcement features that offers improvement on the bending stiffness and tensile strength.

BACKGROUND OF THE INVENTION

Conventional door panels usually includes two door skins adhesively bonded to a core that is made of material that serves the specific purpose of the door panel. Stiles and rails are provided to seal off any free end of the door panel to provide a clean and tidy finishing. The stiles and rails are nailed and/or adhesively glued to the rest of the door panel.

Such doors, especially when used outdoor are exposed to the ever-changing external environment. The humidity and temperature adjustment would force the various parts of the door panel to expand and contract. Over time, this results in cracks and splits. When there is a fire door with high heat tolerance, tensile strength and bending stiffness may help reduce the loss of life and property by slowing or preventing the spread of fire and smoke. This provides additional time for people to escape.

Taking fiberglass door members comprising fiberglass reinforced sheet compression molded skins as an example, it has relatively recently acquired consumer acceptance.

Fiberglass door members typically comprise a door-shaped wooden frame member, a polymeric foam-type core positioned within the frame member, a first fiberglass reinforced compression molded door skin secured to a first side of the frame member, and a second fiberglass reinforced compression molded door skin secured to a second side, opposite the first side, of the frame member. The fiberglass reinforced compression molded door skins are prepared from a molding compound.

The fiberglass door members compare favorably to wood material doors in that they are less expensive than wood material doors. Moreover, fiberglass door members overcome the cracking, splitting, delaminating veneers and poor insulating efficiency associated with wood doors. Furthermore, these fiberglass door members compare favorably to steel doors in that they resist the denting and/or rusting and do not have the cold feel associated with steel doors.

A conventional door with fiberglass reinforced sheet compression molded skins is formed by adhesively joining the skins to the door frame. When it is under the attack of fire, the skin closest to the fire is the first to burn and carbonize. The heat from the fire then penetrates the door causing the adhesive to disintegrate and the skin to detach from the frame, followed by dehydration of the frame resulting in crack formation, disintegration, burning and cabonization. This brings about contraction and thinning. The time required to bring about the bending of the door in a fire is a good indicator of the bending strength of the door. When heat continues to penetrate the door, the cracks expand and the door becomes fragmented and fragile. The resulting door is sustained by the remaining adhesive material. The contraction and thinning of the various materials in the door causes the door to bend and deform.

The invention seeks to eliminate or at least to mitigate such shortcomings for better performance without a substantial increase in costs by providing a new or otherwise improved door panel.

SUMMARY OF THE INVENTION

According to the invention, in a first aspect of the invention there is provided a door panel comprising a body having front and rear door skins delimiting an interior for sandwiching filling material, an interlock provided with the body and configured to lock the front and rear skins to thereby prevent displacement of the front and rear skins along at least two transverse directions, and a reinforcement member provided between the front and rear door skins and extend transversely to the interlock for providing reinforcement to the body.

Preferably, the reinforcement member intersects the interlock to form a reinforcement intersection.

More preferably, the reinforcement member extends perpendicular to the interlock.

Yet more preferably, the reinforcement member is inserted into an aperture preformed in the body and is retained therein by way of friction.

It is preferable that the reinforcement member has friction enhancement means on its outer periphery for enhancing the friction between the outer periphery and the aperture.

Advantageously, the reinforcement intersections are provided at respective apertures preformed at respective corners of the body.

More advantageously, the interlock compartmentalized the interior of the body and the reinforcement member extends across two compartments via the reinforcement intersection.

Yet more advantageously, the four corners are each being reinforced by a pair of reinforcement intersections with the reinforcement members running parallel to one another.

More preferably, the reinforcement member is formed from a material comprises metal.

More preferably, the interlock is formed from the interlocking of first and second locking members one from each of the front and rear door skins.

It is preferable that the first and second locking members are configured complementarily for complementary engagement for thereby interlocking the first and second door skins.

Preferably, the first and second locking members project from the respective front and rear door skins and into the interior such that the interlock is located between the front and rear door skins.

More preferably, the first and second locking members are integrally formed on the respective front and rear door skins as a one-piece structure.

It is preferable that the first locking member includes a guide for guiding movement of the second locking member towards the first locking member.

Advantageously, thickness of the interior is defined by overall length of the interlock.

More advantageously, the first locking member includes a free end shaped to engage with a complementarily shaped free end of the second locking member.

It is advantageous that the free end of the first locking member includes a male engagement member for engaging a female engagement member on the free end of the second locking member.

Preferably, the body includes two specially separated interlocks which are each configured to prevent displacement of the front and rear skins along at least two transverse directions.

More preferably, each of the interlocks includes first and second locking members, the front door skin is provided with two locking members, one from each pair of locking members.

It is preferable that the front door skin is provided with first and second locking members which are structurally distinct and spatially separated.

BRIEF DESCRIPTION OF DRAWINGS

The invention will now be more particularly described, by way of example only, with reference to the accompanying drawings, in which:

FIG. 2C is an enlarged view of the interlock in FIGS. 2A and 2B;

FIG. 6 is a table showing fire test results of a conventional door;

FIG. 7 is a table showing fire test results of a door with the invention which includes interlocks and reinforcement members.

DETAILED DESCRIPTION OF PREFERRED EMBODIMENT

Referring to FIGS. 1 to 5, there is shown an embodiment of the invention in the form of a door panel 100 with front and rear door skins 200 and 300, rails and stiles 101 delimiting an interior 400 to be filled with filling material.

In the specific embodiment, the door skins 200 and 300 are fiberglass reinforced sheet compression molded skins. However, there is no intention to limit the universal application of the invention to doors formed from different methods with different materials in different constructions. As an example, a door with door skin formed from extrusion will not prevent the implementation of the invention therein.

Figures 2A, 2B:
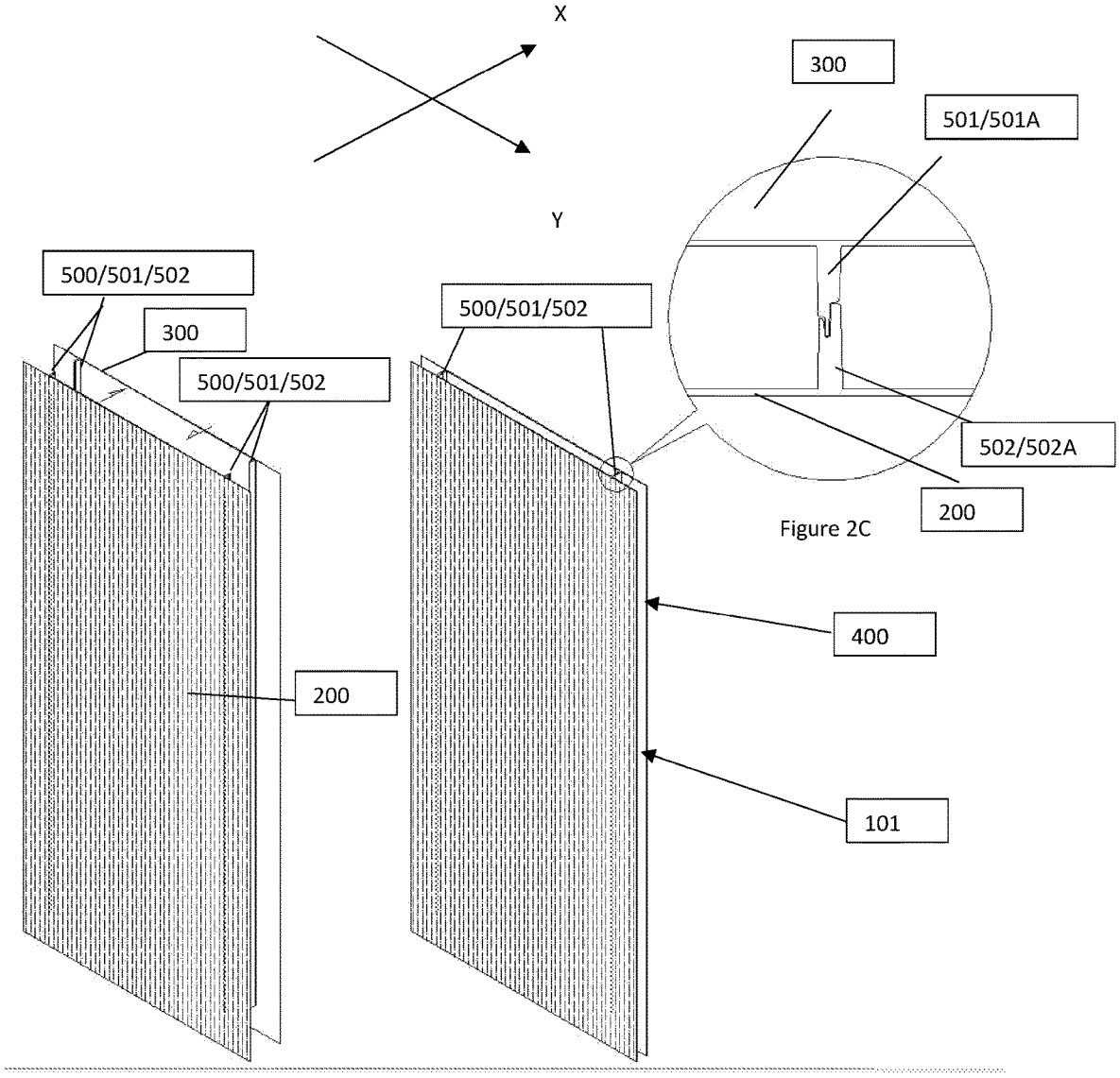
FIGS. 2A and 2B are perspective views of door skins in FIG. 1 being assembled to define an interior and show an interlock formed between the door skins.

Referring to FIGS. 2A and 2B, the door skins 200 and 300 are rectangular plates of material that form the outside of the door panel 100. Usually, the external surfaces of the front and rear door skins 200 and 300 are decorated for aesthetic purposes. At least one interlock 500 is provided between the front and rear door skins 200 and 300 to maintain separation between them as well as preventing relative movements of the front and rear door skins 200 and 300 in at least two transverse directions X and Y. In other words, the interior 400 is maintained by the interlocks 500.

In more detail and with reference to FIG. 2C, the interlock 500 comprises two locking members, the first and second locking members 501 and 502. The first locking member 501 extends or protrudes from an internal surface of the front door skin 200 while the second locking member 502 extends or protrudes from an internal surface of the rear door skin 300. In the embodiment as shown in FIG. 2C with reference to FIG. 1, the first locking member 501 is integrally formed with the front door skin 200. The first locking member 501 and the front door skin 200 are formed as a one-piece structure simultaneously by way of compression moulding. The second locking member 502 is also integrally formed with the rear door skin 300. The second locking member 502 and the rear door skin 300 are also formed as a one-piece structure simultaneously by way of compression moulding.

The first and second locking members 501 and 502 each has a free end. The free ends are each provided with an engagement surface 501A. The engagement surface 501A of the first locking member 501 is shaped complementarily to the engagement surface 502A of the second locking member 502. With reference to FIG. 2C, the engagement surface 501A defines a groove or void for accommodating a corresponding protrusion on the engagement surface 502A. The groove or void also act as a guide to guide movement of the protrusion into it thereby guiding movement of the first and second door skins 200 and 300 towards one another in the direction of X as the door skins are assembled to form the door panel 100. Upon engagement, the locking members 501 and 502 form an interlock 500 between the door skins 200 and 300. More specifically, side walls of the groove or void abut side walls of the protrusion to prevent movement of the locking members 501 and 502, hence the door skins 200 and 300 from moving relative to one another in the direction of Y. Once the protrusion is fully inserted into the groove or void, further movement of the locking members 501 and 502 towards each other, hence movement of the door skins 200 and 300 in the direction of X is prevented. As a result, the interlock 500 once in place would serve to prevent relative movement between the door skins 200 and 300 in both the directions X and Y which are transverse to one another.

Each of the locking members 501 and 502 extends along substantially the entire height of the respective door skin 200 and 300. The resulting interlock 500 compartmentalizes the interior and are functionable as tensile or mechanical reinforcement ribs to offer additional strength to the door panel 100, particularly in the direction along the height of the door panel 100. In an embodiment of the invention, the length of the locking members 501 and 502 is shorter than that of the door skins 200 and 300 at top and bottom ends to define a space for accommodating the top and bottom rails.

Figure 1:
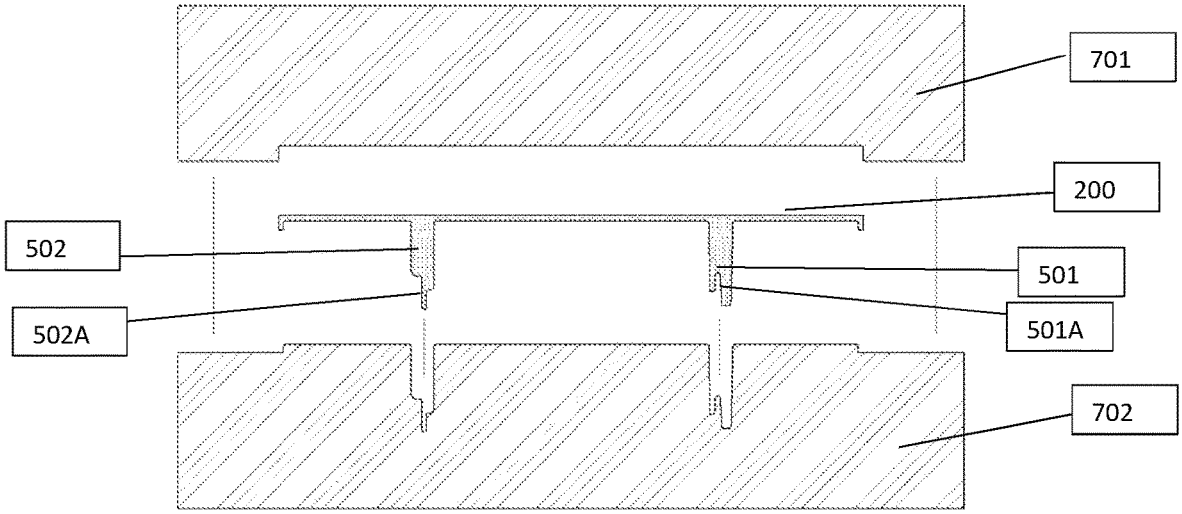
FIG. 1 is a cross-sectional view of a door skin in accordance with the invention and the mold used during sheet compression molding for the production of the door skin.

In the embodiment as shown in FIGS. 1 to 2C, there are two pairs of interlocks 500 between the door skins 200 and 300 of a door panel 100. On the front door skin 200, there are two locking members, first and second locking members 501 and 502 on the same inner side of the front door skin 200. The first and second locking members 501 and 502 are arranged in spatial separation from one another. On the rear door skin 300, again two locking members, second and first locking members 502 and 501 are provided on the same inner side. These locking members are arranged at positions on the rear door skin 300 that correspond to those on the front door skin 200.

To facilitate the formation of the door skins 200 and 300, it is possible that the front and rear door skins 200 and 300 are identical and formed from a same mold 701 and 702 except that when they are in use, they are oriented differently.

As an alternative, it may be possible for the front door skin 200 to be provided with two first locking members 501 while the rear door skin 300 is provided with two second locking members 502.

Furthermore, in an alternative embodiment, the second locking member 502 may be an indentation with an engagement surface 502A being shaped complementarily to that of the first locking member 501.

Figure 3:
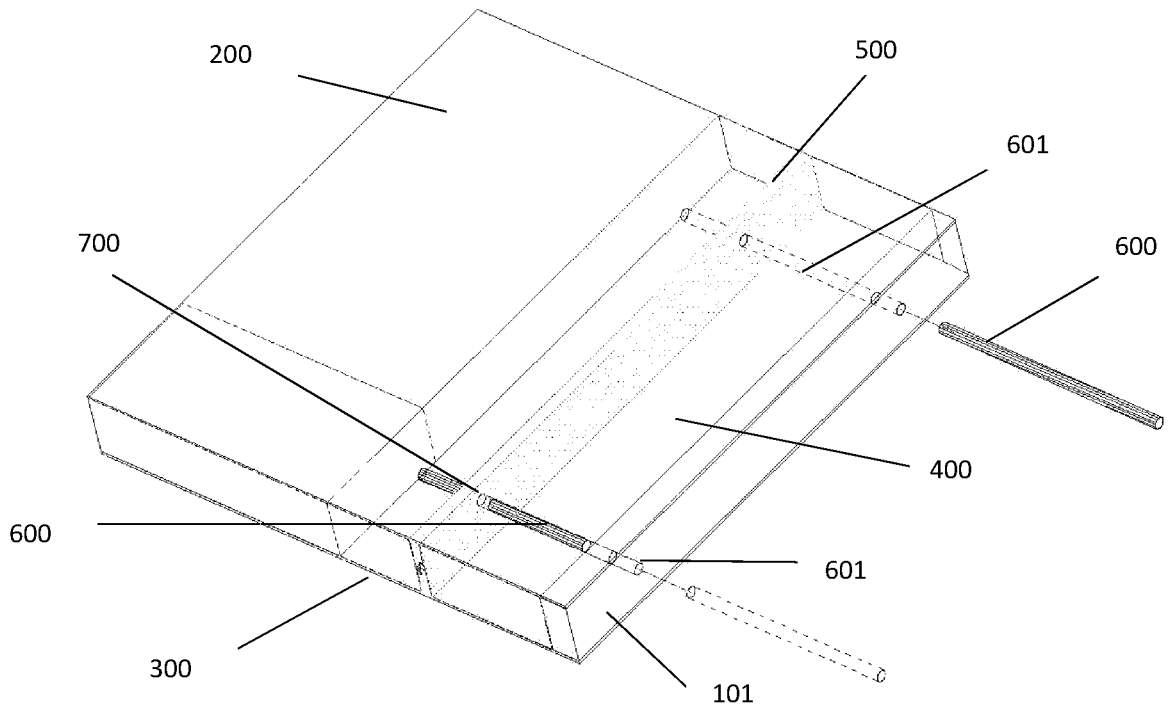
FIG. 3 is an illustrative view of a part of the door panel in FIGS. 2A and 2B with a pair of reinforcement members being inserted into the interior via the interlock.
Figure 5:
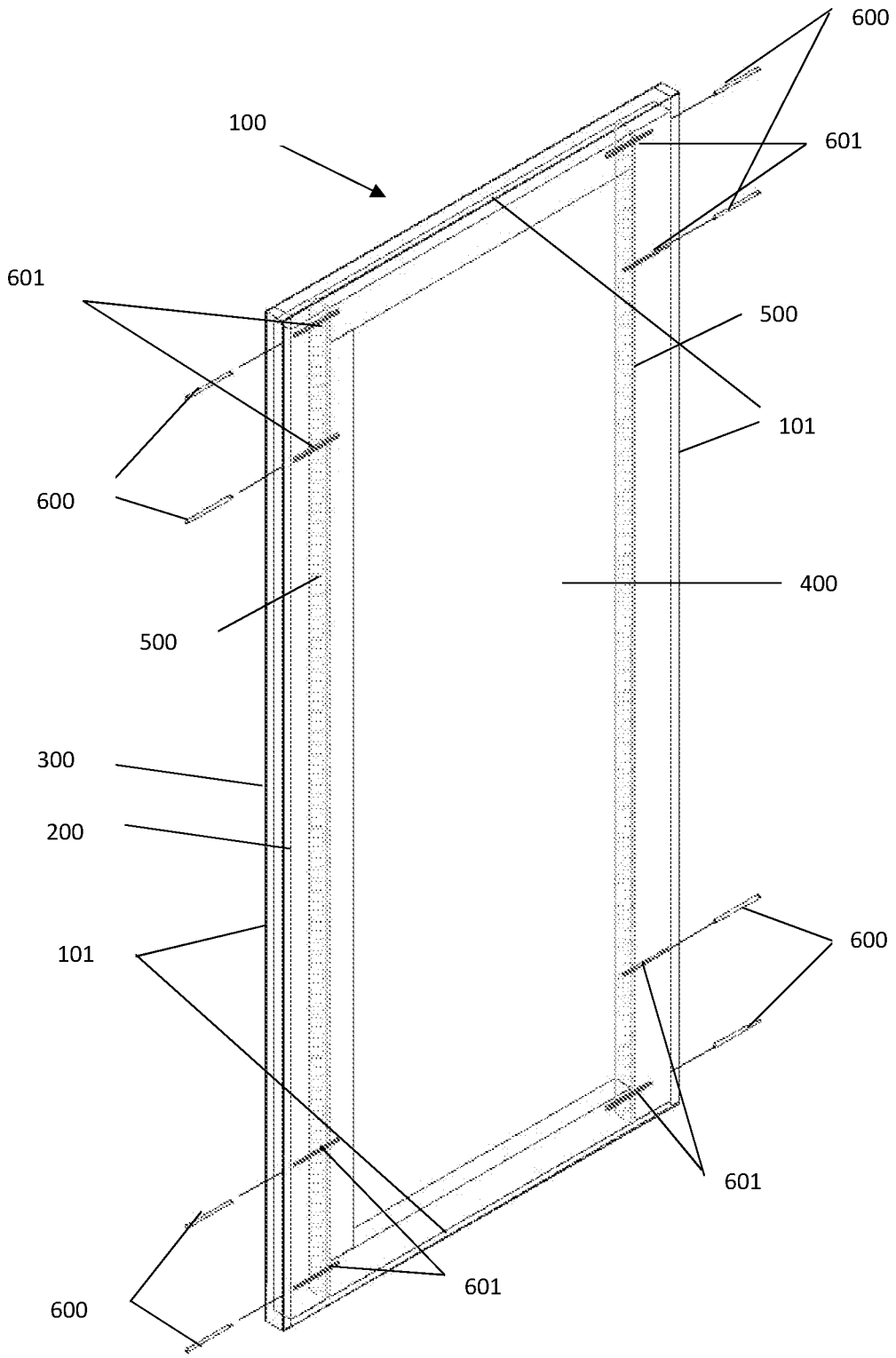
FIG. 5 is a perspective view of the door panel in accordance with the invention having interlocks and eight reinforcement members arranged to intersect with the respective interlocks.
Figure 8:
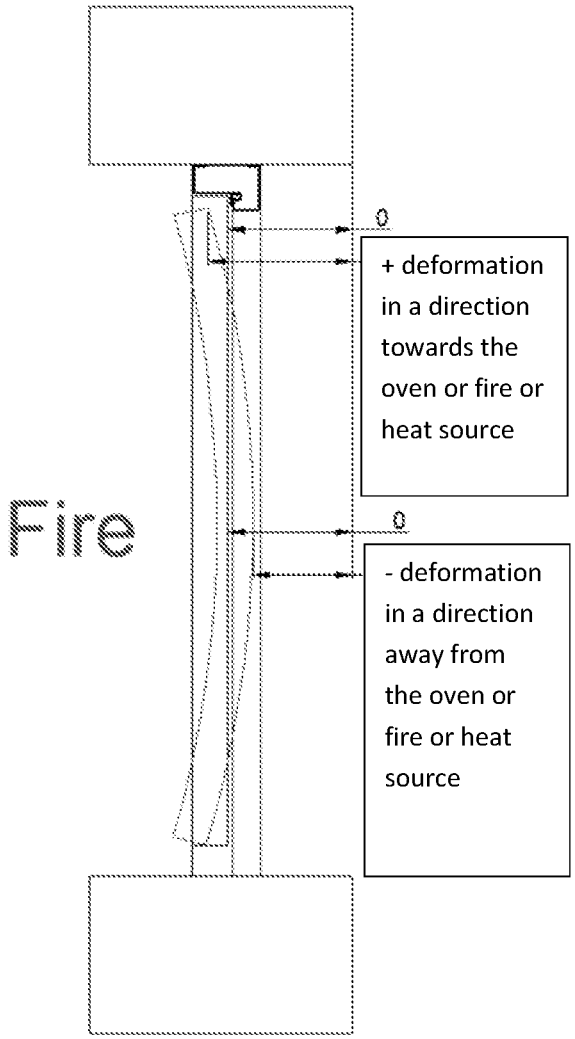
FIG. 8 shows the direction of deformation or bending of a door subject to the fire test.

The door panel 100 as detailed above benefits from the improved mechanical support offered by the interlocks 500 in addition to maintaining the interior 400 and preventing relative movement between the door skins 200 and 300. To enhance the bending stiffness of the door panel 100 along substantially the entire height thereof, in particular under severe condition such as when the door panel 100 is subject to high heat, reinforcement members 600 in FIGS. 3 and 5 are tactfully installed in the door panel 100. The material from which the reinforcement member 600 is made is carefully selected. It must be able to ensure heat without deformation at reasonable cost and be easy to install without overburdening the manufacturing process.

Figure 4A:
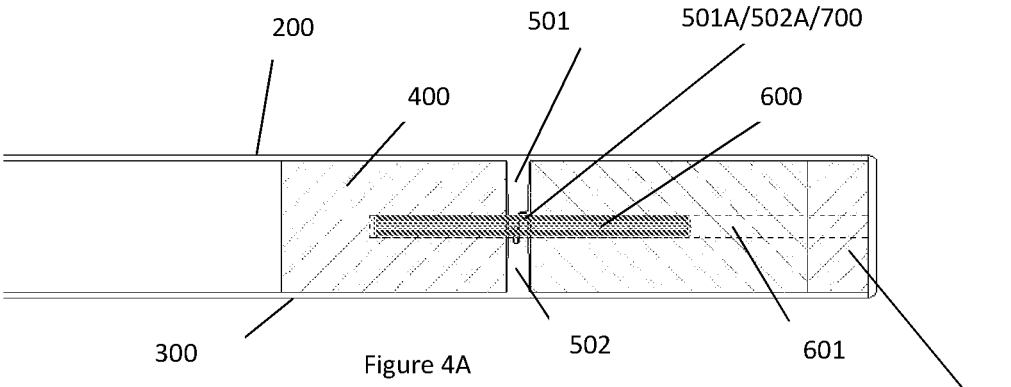
FIG. 4A and FIG. 4B are enlarged cross-sectional views of part of the door panel with respective interlocks.
Figure 4B:
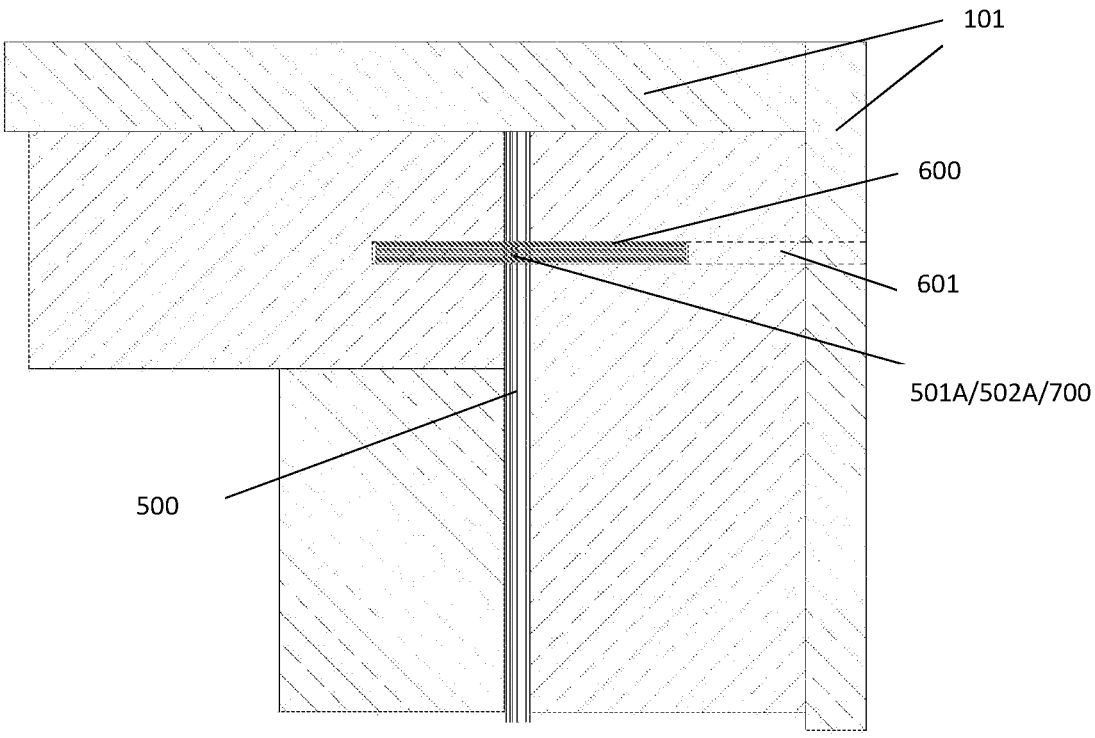

In the embodiment of the invention as shown in FIGS. 4A to 5, the reinforcement members 600 are in the form of metal rods or are made from a material with tensile strength greater than that of the rest of the door panel 100. The reinforcement members 600 are provided in the interior 500 of the door panel 100 to enhance the tensile strength and the bending stiffness of the overall door panel 100 in a direction transverse to the height of the door panel 100. As shown in FIG. 3, insertion of the reinforcement member 600 is guided by a guide preformed on the door panel 100. In the specific embodiment, the reinforcement member 600 is inserted in a pre-drilled aperture 601 to intersect with the interlock 500. The reinforcement member 600 runs transverse to and in the specific embodiment, perpendicular to the interlock 500. As shown in FIGS. 4A and 4B, the reinforcement member 600 runs through the engagement surfaces 501A and 502A from one side of the interlock 500 to the other side thereof. As explained above, the interlock 500 partitions or compartmentalizes the interior 400 such that the reinforcement member 600 extends from one compartment to another via the interlock 500.

In more detail, as shown in FIG. 5, a pair of interlocks 500 runs along the height of the door panel 100 in the interior 400. The interlocks 500 are shorter than the height of the door skins 200 and 300 leaving respective clearance at the top and bottom sides of the door skins 200 and 300 to define top and bottom spaces for accommodating top and bottom rails therein respectively. These interlocks 500 are separated spatially and are positioned adjacent to the left and right extremities of the door panel 100. These interlocks 500 partition the interior 400 into three compartments, the left, right and center compartments. The door panel 100 takes the shape of a rectangle with four corners. At each corner, a pair of reinforcement members 600 are arranged parallel to each other and perpendicular to the relevant interlock 500. The pair of reinforcement members 600 are provided on a same plane yet are vertically displaced. As a result, there are eight reinforcement members 600 two at each corner of the door panel 100. With reference to FIGS. 3 and 5, the apertures 601 are formed through the stiles 101 and into the interior 400. After the insertion of the reinforcement members 600, the apertures 601 for accommodating them may be sealed off by any conventional means. The reinforcement member 600 is dimensioned to form a tight fit with an interior wall of the aperture 601 such that the reinforcement member 600 is retained in the aperture 601 by friction. Adhesive may not be required to fix the positions of the reinforcement members 600 in the door panel 200. Corrugations are provided on an outer surface of the reinforcement members 600 to function as friction enhancers and thereby enhance the friction between the reinforcement members 600 with the interior walls of the respective apertures 601.

In FIGS. 4A and 4B, eight reinforcement intersections 700 are formed where the respective reinforcement members 600 intersect the respective interlocks 500. These intersections substantially improve the mechanical and tensile strength as well as the bending stiffness of the overall door panel 100. Force applied on the door skins 200 and 300 is evenly spread to the entire door panel via the reinforcement members 600 and the interlocks 500 thereby improving the bending stiffness of the overall door panel 100. In an alternative embodiment, the reinforcement members 600 may extend across the entire width of the door panel 100, such that only four are required.

The door skins 200 and 300 are held in place relative to one another by the interlocks 500 and the reinforcement members 600 in addition to adhesive. These parts of the door panel 100 are held together without the use of adhesive. Heat endurance of the interlocks 500 and the reinforcement members 600 is comparatively much better than that of adhesive. The door skins 200 and 300 are less likely to detach from one another and heat is less likely to penetrate as quickly as with conventional doors in which the door skin is secured by adhesive. The resulting door panel 100 is less likely to disintegrate or fall apart.

The reinforcement members 600 integrate or join various parts of the door panel 100 together such that when the door panel 100 is subject to fire and heat, even though any wood components contract, the reinforcement members 600 serve to resist the bending of the door panel 100 and its disintegration. The adhesive that binds the door skins 200 and 300 to the door frame will disintegrate but are maintained in position and attached to the rest of the door panel 100 by the reinforcement member 600 and the interlock 500. Disintegration of the overall door panel 100 is postponed or slowed down. The resulting door panel 100 is able to resist deformation for a longer period of time in a fire.

In an embodiment of the invention, the door skins 200 and 300 are made of sheet molding composite (SMC), a ready to mold glass-fiber reinforced polyester material. The rails and stiles 101 have wooden cores covered by plastic outer skin. The filling material that fills the interior 500 comprises PU foam or phenolic foam (fire resistant). Interlocks 500 run along height of the door panel 100 and reinforcement members 600 are provided at the corners of the door panel 100 as detailed above.

In a conventional door panel 100, the door skins are adhesively attached to the core. There is no interlock or reinforcement member.

When subject to heating, various parts of the door panel 100 will separate from one another, thereby progressively lowering the tensile and mechanical strength as well as the bending stiffness of the door panel 100. This is illustrated by the following fire tests.

Fire Tests

With reference to FIGS. 5 and 6, fire tests were performed on a conventional door panel and the door panel 100 with the invention respectively. After prolonged heating at a temperature of about 1000 degree C. in an oven that simulates the conditions when the doors are subject to the burning of fire, the deformation of the conventional door is more substantial than that of the door with the invention.

In more detail, as an example, for the conventional door, when it is heated for 30 minutes and the oven is at 1043 degree C., the deformation at position A' is +30.1 while that at position B' is +14.1. When the door with the invention is heated for 70 minutes and the oven is at 1022 degree C., the deformation of the door with the invention at position A is +17.9 and at position B' is −2.9. With reference to FIG. 7, the sign + indicates a bending direction towards the fire source and the sign − indicates a bending direction away from the fire source. The number indicates the magnitude of deformation. The magnitude of deformation at position A' in the door with the invention is about half of that in a convention door. The magnitude of deformation at position B' in a convention door is 7 times higher than the door with the invention. The sign +/− indicate the direction of bending in the deformation. The test clearly demonstrate the durability of the door with the invention, in particular its ability to resist deformation as a result of relatively higher mechanical and tensile strength as well as higher bending stiffness.

In another example, for the conventional door, when it is heated for 16 minutes and the oven is at 888 degree C., the deformation at position A' is +17.9 while that at position B' is +9.9 and at position C' is +6.6. When the door with the invention is heated for 30 minutes and the oven is at 888 degree C., the deformation of the door with the invention at position A is +15.0 and at position B' is +0.54. Again, the figures show that the deformation in the door panel in accordance with the invention is smaller at various locations of the door when compared to that of a conventional door.

The conventional door has a 1110 mm×2388 mm door panel in a 1200 mm×2400 mm door frame with sheet compression molded fiberglass skins sandwiching a phenolic foam core without reinforcement member 600 or interlock 500. The door with the invention has a 1110 mm×2440 mm door panel in a 1200 mm×2500 mm door frame with sheet compression fiberglass skins sandwiching a phenolic foam core with reinforcement member 600 and interlock 500. The position A' is a upper corner of the door being tested on the side where the door handle is provided while position B' is a lower corner of the door being tested on the same side of the door as position A'.

The invention has been given by way of example only, and various other modifications of and/or alterations to the described embodiment may be made by persons skilled in the art without departing from the scope of the invention as specified in the appended claims.

The invention claimed is:

1. A door panel comprising:

a body having front and rear door skins delimiting an interior for sandwiching filling material, an interlock provided within the body and configured to lock the front and rear door skins together and to thereby prevent displacement of the front and rear skins along at least two transverse directions, a reinforcement member provided inside the body between the front and rear door skins and transversely extending through the interlock for providing reinforcement to the body, and the interlock being configured for compartmentalizing the interior of the body and the reinforcement member extending across two compartments as the reinforcement member extends through the interlock.

2. The door panel as claimed in claim 1, wherein the reinforcement member intersects the interlock to form a reinforcement intersection.

3. The door panel as claimed in claim 2, wherein the reinforcement member extends perpendicular to the interlock.

4. The door panel as claimed in claim 1, further comprising an aperture preformed in the body wherein the reinforcement member is inserted into the aperture and is retained therein by friction.

5. The door panel as claimed in claim 4, wherein the reinforcement member has friction enhancement means on its outer periphery for enhancing the friction between the outer periphery and the aperture.

6. The door panel as claimed in claim 5, further comprising reinforcement intersections provided at respective apertures preformed at respective corners of the body.

7. The door panel as claimed in claim 1, wherein each of four corners of the body is reinforced by a pair of reinforcement intersections with reinforcement members running parallel to one another.

8. The door panel as claimed in claim 1, wherein the reinforcement member is formed from a material that comprises metal.

9. The door panel as claimed in claim 1, further comprising first and second locking members, extending from the doors skins, and the interlock is formed from interlocking of the first and second locking members.

10. The door panel as claimed in claim 9, wherein the first and second locking members are configured complementarily for complementary engagement and for thereby interlocking the front and rear door skins.

11. The door panel as claimed in claim 10, wherein the first and second locking members project from respective ones of the front and rear door skins and into the interior such that the interlock is located between the front and rear door skins.

12. The door panel as claimed in claim 11, wherein the first and second locking members are integrally formed with and on the respective front and rear door skins.

13. The door panel as claimed in claim 10, wherein the first locking member includes a guide for guiding movement of the second locking member towards the first locking member.

14. The door panel as claimed in claim 9, wherein a thickness of the interior is defined by an overall length of the interlock.

15. The door panel as claimed in claim 10, wherein the first locking member includes a free end shaped to engage with a complementarily shaped free end of the second locking member.

16. The door panel as claimed in claim 15, wherein the free end of the first locking member includes a male engagement member for engaging a female engagement member on the free end of the second locking member.

17. The door panel as claimed in claim 9, wherein the interlock includes two separated interlocks, wherein each of the interlocks is configured to prevent displacement of the front and rear skins along at least two transverse directions.

18. The door panel as claimed in claim 17, wherein each of the interlocks includes the first and second locking members, and the front door skin is provided with two locking members from the first and second locking members.

19. The door panel as claimed in claim 18, wherein the front door skin is provided with first and second locking members which are structurally distinct and spatially separated.

* * * * *